US010048030B2

(12) United States Patent
Corso

(10) Patent No.: US 10,048,030 B2
(45) Date of Patent: Aug. 14, 2018

(54) FIREARM MAGAZINE FLOOR PLATE ASSEMBLY

(71) Applicant: Steven Corso, Jupiter, FL (US)

(72) Inventor: Steven Corso, Jupiter, FL (US)

( * ) Notice: Subject to any disclaimer, the term of this patent is extended or adjusted under 35 U.S.C. 154(b) by 0 days.

(21) Appl. No.: 15/680,904

(22) Filed: Aug. 18, 2017

(65) Prior Publication Data

US 2018/0051948 A1 Feb. 22, 2018

Related U.S. Application Data

(60) Provisional application No. 62/376,566, filed on Aug. 18, 2016.

(51) Int. Cl.
*F41A 9/65* (2006.01)

(52) U.S. Cl.
CPC ..... *F41A 9/65* (2013.01)

(58) Field of Classification Search
CPC ..... F41A 9/65
USPC ..... 42/50
See application file for complete search history.

(56) References Cited

U.S. PATENT DOCUMENTS 5,438,783 A * 8/1995 Sniezak ..... F41A 9/65 42/50
7,093,386 B1 * 8/2006 Vieweg ..... F41A 9/65 42/7
7,373,751 B1 * 5/2008 Schaffer ..... F41A 9/59 42/50
9,752,839 B2 * 9/2017 Ballard ..... F41A 9/70

* cited by examiner

*Primary Examiner* — J. Woodrow Eldred
(74) *Attorney, Agent, or Firm* — Robert M. Downey, PA

(57) ABSTRACT

A floor plate assembly for a firearm magazine for use in automatic and semi-automatic pistols and rifles is designed to occupy a minimal amount of space inside the magazine so that more magazine volume is available for bullets in a minimal magazine size. The magazine floor plate assembly includes a floor plate and a lock plate. The floor plate includes opposing lock plate guides that secure to the base flanges of a magazine housing. The lock plate acts as a spring for snap assembly and is inserted underneath the back edge of the magazine housing over the bottom inside surface of the floor plate, so that the lock plate covers the open magazine back side, while keeping the floor plate tight and without movement.

5 Claims, 2 Drawing Sheets

FIREARM MAGAZINE FLOOR PLATE ASSEMBLY

This non-provisional patent application is based on provisional patent application Ser. No. 62/376,566 filed Aug. 18, 2016.

BACKGROUND OF THE INVENTION

Field of the Invention

The present invention relates to firearm magazines, and more particularly, to a floor plate assembly for attachment to magazines used in automatic and semiautomatic pistols and rifles for maximizing volume within the magazine and eliminating movement of the floor plate.

Discussion of the Related Art

Different methods have been used to secure floor plates to the open bottom ends of firearm magazine housings. While in many cases floor plates are welded to the housing, it is preferable to provide a removable base for easier access to internal parts and for cleaning. It is also desirable that the parts used for attachment use minimum space inside the magazine so that there is maximum space for spring(s) and bullets in order to make the overall design as compact as possible. The use of screws or other fasteners that require the use of a specific tool for assembly or disassembly are less desirable as the tool may not be available in the event that cleaning or repair must be done in the field or in an emergency situation.

Extended magazine bases are sometimes used to increase the capacity of magazines that are designed with removable bases. These extended magazine bases attach to the magazine housing, but instead of closing the open magazine bottom nearly flush, they provide a cavity that adds room for additional bullets. If the magazine extensions are made from injection molded plastic, tooling is complicated and expensive due to the internal features necessary within a shape that has a closed bottom and four sides. Machining the parts is an option at the expense of per part cost. A simpler and less expensive tool can be made if one end of the four sides could be eliminated, but this introduces new issues to overcome related to covering the opening while maintaining a robust assembly.

Typically, the lock plates used with these magazine extensions require a vertical flange or flanges that are used to capture the inside of the magazine and secure the assembly. However, these flanges take up valuable space inside the magazine.

In all applications that are not welded there is some sort of movement of the floor plate after assembly. This is due to tolerances that must be allowed for assembly and fitment. Since the floor plate in an automatic pistol is exposed at the end of the grip and is often part of the grip, it is desirable to have as little movement as possible so that the shooter has maximum control and a secure feel.

In view of the foregoing, there is a need for an improved magazine floor plate attachment method that maintains the lowest profile possible while accommodating simple tooling and eliminating floor plate movement.

Objects and Advantages of the Invention

A firearm magazine floor plate and lock plate designed to:

Minimize space consumption inside the magazine so that maximum volume is available for bullets in a minimal magazine size Cover the open space created at the lower back of the magazine (when applicable)

Create a secure fastening method that does not use screw type fasteners and cannot be inadvertently disassembled without pushing the locking tab Eliminate all movement of the floor plate Simplify tooling as much as possible

SUMMARY OF THE INVENTION

The present invention is directed to a magazine floor plate assembly, including a floor plate and lock plate that when assembled allows minimum space to be used inside the magazine, while providing a robust zero movement assembly.

The lock plate acts as a spring for snap assembly, provides a cover for an open magazine back side when a three sided extended floor plate is used, and keeps the floor plate tight and without movement. This is all accomplished without the use of screws or other fasteners that may require a specific tool for assembly or disassembly.

The floor plate may be typical, without extended length, allowing the inside base of the floor plate to mate with the lower edges of the magazine housing. Alternatively, the floor plate may be extended with three sides and an open back.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
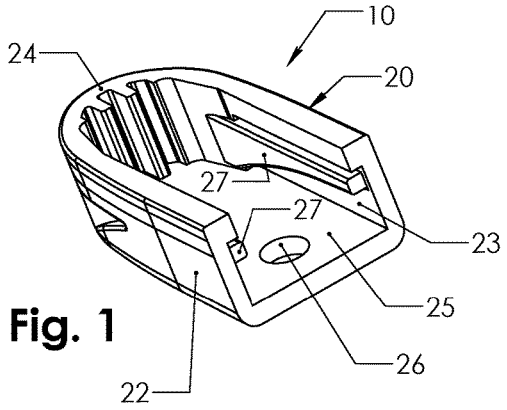
FIG. 1 is a top, rear perspective view of the floor plate of the present invention.
Figure 2:
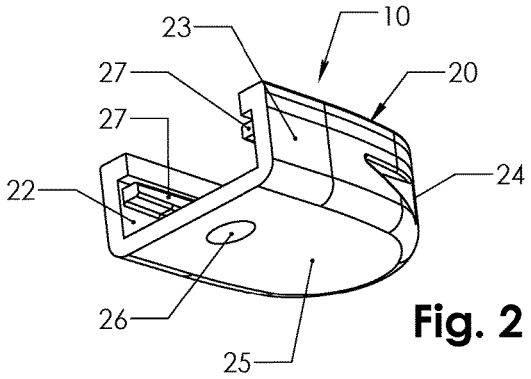
FIG. 2 is a bottom, rear perspective view of the floor plate.

The floor plate assembly is generally indicated as 10 throughout the drawings and includes a floor plate 20 and a lock plate 36. In one preferred embodiment, as shown in FIGS. 1-2, the floor plate 20 includes opposite sides 22, 23, a front end 24, a bottom 25 and an open back end. The bottom 25 has a thru receiving hole 26. The two opposing sides 22, 23 contain lock plate guides 27 on their inner facing surfaces as embedded features.

Figure 3:
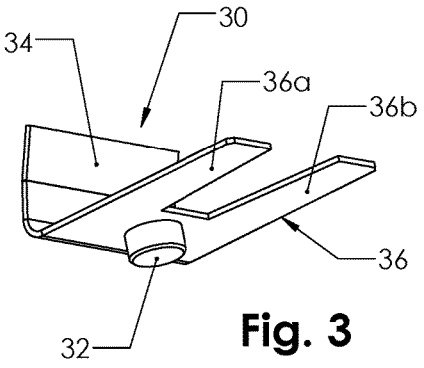
FIG. 3 is a bottom perspective view of the lock plate of the present invention.
Figure 4:
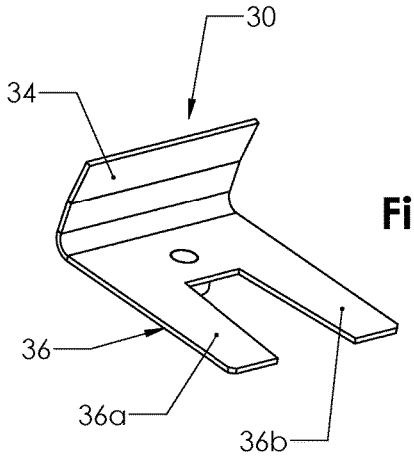
FIG. 4 is a top perspective view of the lock plate.
Figure 5:
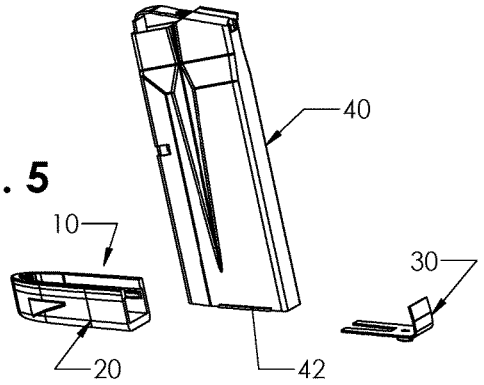
FIG. 5 is an exploded perspective view of a preassembled magazine with the floor plate and the lock plate separated from the magazine.
Figure 6:
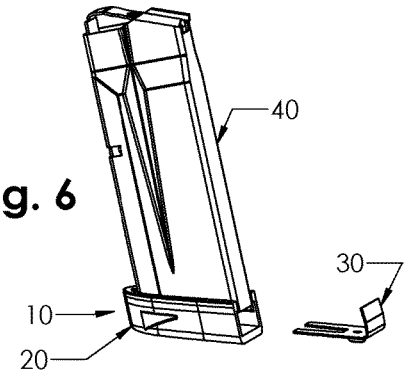
FIG. 6 is a perspective view of the magazine with the floor plate assembled in place and the lock plate separated.
Figure 7:
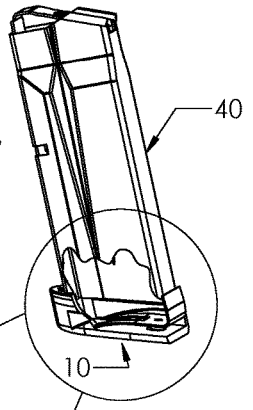
FIG. 7 is a perspective view, in partial cutaway, of the magazine with the floor plate assembled in place and the lock plate partially engaged.
Figure 7A:
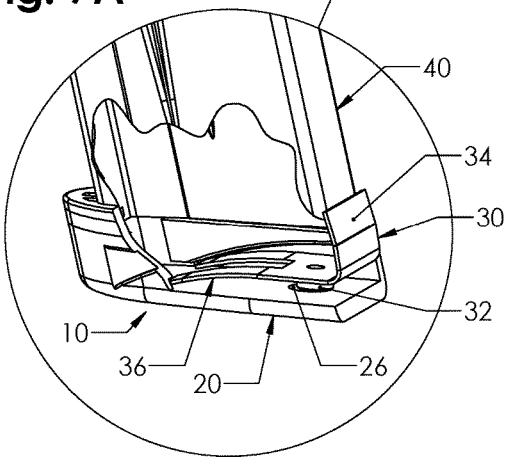
FIG. 7A is a detailed isolated perspective view taken from the area indicated as 7A in FIG. 7, and shown in partial cutaway, illustrating the magazine with the floor plate assembled in place and the lock plate partially engaged.
Figure 8:
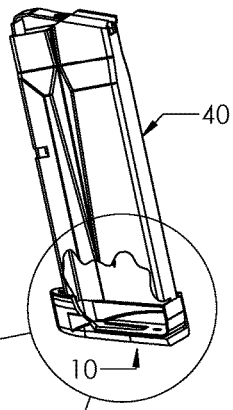
FIG. 8 is a perspective view, in partial cutaway, of the assembled magazine and floor plate assembly of the present invention.
Figure 8A:
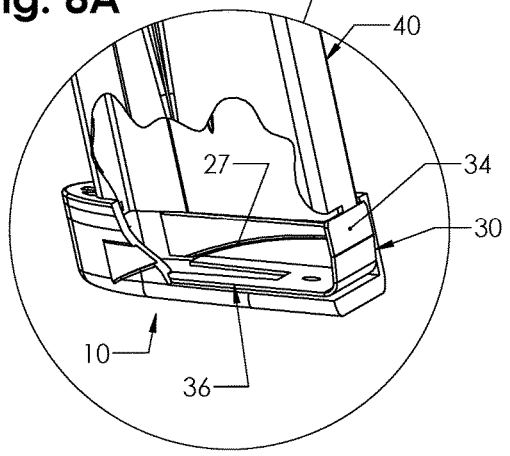
FIG. 8A is a detailed isolated perspective view taken from the area indicated as 8A in FIG. 8, and shown in partial cutaway, illustrating the assembled magazine and floor plate assembly of the present invention.

The lock plate 30, as seen in FIGS. 3-4, is made of a material with spring properties, such as spring steel. The lock plate 30 may contain two spring prongs 36*a*, 36*b* that are cut from the shape of the base 36 of the lock plate 30. The bottom side of the base 36 contains a locking tab 32 that may be a feature of the base 36 or may be a separate part that is assembled together with the lock plate 30. The lock plate 30 has an end flange 34 that is angled near perpendicular to the base 36.

Referring to FIGS. 5-8A, to assemble the floor plate 20 onto the magazine housing 40, the floor plate 20 receives the magazine base flanges 42, of which there is one on each side of the magazine housing 40, into slots in the sides of the floor plate 20. The lock plate 30 is inserted underneath the back edge of the magazine housing 40 and over the bottom inside surface of the floor plate 20. As the floor plate 20 and the lock plate 30 come together, the locking tab 32 rides on the top inside surface of the bottom of the floor plate 20 and the forward end(s) of the lock plate 30 or spring prongs 36*a*, 36*b* are guided (bent) downward following the lock plate guides 27 on the inside sides 22, 23 of the floor plate 20. The end flange 34 contacts the back of the magazine housing 40 just before the locking tab 32 snaps into the receiving hole 26 in the bottom 25 of the floor plate 20 and requires slight deflection to accomplish final assembly. Since the lock plate 30 is made of a spring material, the bottom surface flattens back to its original shape while tension is created between the receiving hole 26 and the back surface of the magazine housing 40 by the remaining deflection of the end flange 34 after assembly, thereby eliminating any possible movement of the floor plate 20.

To disassemble, the locking tab 32 must be pressed with a narrow object until it clears the inside surface of the bottom 25 of the floor plate 20 when the floor plate 20 can slide forward. Disassembly cannot be accomplished by pushing up on the end flange 34 alone as the lock plate 30 will contact the lock plate guides 27 before the locking tab 32 is completely disengaged from the receiving hole 26.

While the present invention has been shown and described in accordance with a preferred and practical embodiment thereof, it is recognized that departures from the instant disclosure are fully contemplated within the spirit and scope of the invention which is not to be limited except as defined in the following claims as interpreted under the Doctrine of Equivalents.

What is claimed is:

1. A floor plate assembly for attachment to an open bottom of a firearm magazine, the floor plate assembly comprising:

a floor plate including opposite sides, a front end, a bottom and an open back end, and the floor plate being sized, structured and disposed for covering engagement over the open bottom of the magazine; and a locking plate having spring biasing properties, and including a base and an end flange extending upwardly from a rear end of the base, and the locking plate being structured and disposed for sliding insertion through the open back end of the floor plate and between the open bottom of the magazine and the bottom of the floor plate for creating tension to hold the floor plate on the bottom of the magazine without movement of the floor plate relative to the magazine.

2. The floor plate assembly as recited in claim 1 further comprising:

lock plate guides formed on inner facing surfaces of the opposite sides of the floor plate for urging the base of the locking plate into a spring biased orientation upon sliding movement of the locking plate between the open bottom of the magazine and the bottom of the floor plate with the floor plate positioned in covering relation over the open bottom of the magazine.

3. The floor plate assembly as recited in claim 2 wherein the end flange of the locking plate is structured and disposed for covering the open back end of the floor plate when the locking plate is fully inserted between the open bottom of the magazine and the bottom of the floor plate.

4. The floor plate assembly as recited in claim 3 further comprising:

a protruding locking member on a bottom surface of the base of the locking plate; and a receptacle formed in the bottom of the floor plate for snap-fit receipt of the protruding locking member therein upon full insertion of the locking plate between the bottom of the floor plate and the open bottom of the magazine with the end flange of the locking plate positioned in covering relation over the open back end of the floor plate.

5. The floor plate assembly as recited in claim 4 wherein the base of the locking plate includes a pair of spring prongs extending in spaced relation to one another and each terminating at a distal end, and the pair of spring prongs being structured and disposed for guided sliding movement relative to the lock plate guides to urge the base of the locking plate into the spring biased orientation.

* * * * *